US011273851B2

(12) United States Patent
Huck et al.

(10) Patent No.: US 11,273,851 B2
(45) Date of Patent: Mar. 15, 2022

(54) RAILCAR WITH ADJUSTABLE OPENING LONGITUDINAL GATES

(71) Applicant: Trinity North American Freight Car, Inc., Dallas, TX (US)

(72) Inventors: Kenneth W. Huck, Fairview, TX (US); Andrew Brown, Plano, TX (US); Lee A. Reitz, Euless, TX (US); Anthony R. Hiatt, Fort Worth, TX (US); Amy D. Brown, North Richland Hills, TX (US); Daniel G. Cortez, Grapevine, TX (US); Christopher C. Harkey, Dallas, TX (US)

(73) Assignee: TRINITY NORTH AMERICAN FREIGHT CAR, INC., Dallas, TX (US)

( * ) Notice: Subject to any disclaimer, the term of this patent is extended or adjusted under 35 U.S.C. 154(b) by 235 days.

(21) Appl. No.: 16/571,719

(22) Filed: Sep. 16, 2019

(65) Prior Publication Data

US 2020/0010097 A1 Jan. 9, 2020

Related U.S. Application Data

(63) Continuation of application No. 15/428,666, filed on Feb. 9, 2017, now Pat. No. 10,449,975.

(51) Int. Cl.

| | |
|---|---|
| ***B61D 7/02*** | (2006.01) |
| ***E05F 15/53*** | (2015.01) |
| ***B61D 7/24*** | (2006.01) |

(52) U.S. Cl.

CPC ..... *B61D 7/02* (2013.01); *B61D 7/24* (2013.01); *E05F 15/53* (2015.01);
(Continued)

(58) Field of Classification Search

CPC ... B61D 7/02; B61D 7/24; B61D 7/28; B61D 7/18; B61D 7/26; B61D 7/16;
(Continued)

(56) References Cited

U.S. PATENT DOCUMENTS

| | | | | |
|---|---|---|---|---|
| 3,295,704 | A | 1/1967 | Gillick et al. | |
| 3,828,948 | A * | 8/1974 | Peterson | B61D 7/28 414/387 |

(Continued)

FOREIGN PATENT DOCUMENTS

| | | |
|---|---|---|
| DE | 3920776 A1 | 1/1991 |
| EP | 0417657 A1 | 3/1991 |

(Continued)

OTHER PUBLICATIONS

International Search Report and Written Opinion for PCT Patent Application No. PCT/US2018/016421, dated May 9, 2018; 15 pages.

*Primary Examiner* — Mark T Le
(74) *Attorney, Agent, or Firm* — Baker Botts, LLP

(57) ABSTRACT

A railcar system that includes a railcar with a discharge opening and a longitudinal gate positioned adjacent to the discharge opening. The system further includes a driving system connected to the longitudinal gate that is configured to move the longitudinal gate between a closed position and an open position. The system further includes a controller connected to the driving system that causes the driving system to position the longitudinal gate in the closed position, position the longitudinal gate in the open position, and position the longitudinal gate to remain an at least partially open position. The longitudinal gate is less than fully open when the longitudinal gate is in the at least partially open position.

11 Claims, 5 Drawing Sheets

(52) U.S. Cl.
CPC ... *E05Y 2201/422* (2013.01); *E05Y 2201/622* (2013.01); *E05Y 2900/51* (2013.01)

(58) Field of Classification Search
CPC ..... E05F 15/53; E05Y 2201/422; E05Y 2201/622; E05Y 2900/51; B60P 1/56
See application file for complete search history.

(56) References Cited

U.S. PATENT DOCUMENTS

| | | | | |
|---|---|---|---|---|
| 4,004,700 | A | 1/1977 | Empey | |
| 4,099,159 | A * | 7/1978 | Windisch | G05D 3/14 340/432 |
| 5,284,097 | A * | 2/1994 | Peppin | E01B 27/02 104/88.02 |
| 6,526,339 | B1 * | 2/2003 | Herzog | B61L 25/025 105/311.1 |
| 7,093,544 | B1 * | 8/2006 | Allen | B61D 7/30 105/286 |
| 7,735,426 | B2 | 6/2010 | Creighton | |
| 7,980,636 | B2 * | 7/2011 | Miller | B60P 1/56 298/29 |
| 2002/0073882 | A1 * | 6/2002 | Howard | E01B 27/022 105/247 |
| 2013/0019776 | A1 | 1/2013 | Wang et al. | |
| 2014/0044507 | A1 * | 2/2014 | Naizer | B65G 43/00 414/288 |
| 2017/0109027 | A1 * | 4/2017 | Shubs, Jr. | G06F 3/04845 |

FOREIGN PATENT DOCUMENTS

| | | | |
|---|---|---|---|
| EP | 0749879 | A1 | 12/1996 |
| WO | 2005021350 | A1 | 3/2005 |

* cited by examiner

RAILCAR WITH ADJUSTABLE OPENING LONGITUDINAL GATES

RELATED APPLICATION

This application is a continuation under 35 U.S.C. § 120 of U.S. application Ser. No. 15/428,666, filed Feb. 9, 2017 and entitled Railcar with Adjustable Opening Longitudinal Gates, incorporated herein by reference.

TECHNICAL FIELD

This disclosure relates generally to railcars and more particularly to railcars which discharge cargo or lading, such as coal, ore, ballast, grain, and any other lading suitable for transport in railcars.

BACKGROUND

Railway hopper cars with one or more hoppers are used for transporting commodities such as dry bulk. For example, hopper cars are frequently used to transport coal, sand, metal ores, ballast, aggregates, grain, and any other type of lading material. Commodities are discharged from openings typically located at or near the bottom of a hopper. Existing systems use a door or gate assembly to open and close discharge openings of a hopper. Existing gate assemblies use gates that can only be configured in a fully open or fully closed position and cannot be configured with an attenuated flowrate. The system receiving the unloaded commodity may become overwhelmed by too much product being discharged at once when the flowrate is too great. Thus, it is desirable to provide more flexibility and options when discharging commodities.

SUMMARY

In one embodiment, the disclosure includes a railcar system that includes a railcar with a discharge opening and a longitudinal gate positioned adjacent to the discharge opening. The system further includes a driving system connected to the longitudinal gate. The driving system is configured to move the longitudinal gate between a closed position and an open position. The longitudinal gate disallows a flow path via the discharge opening when the longitudinal gate is in the closed position. The longitudinal gate allows a flow path via the discharge opening when the longitudinal gate is in the open position. The system further includes a controller connected to the driving system. The controller causes the driving system to position the longitudinal gate in the closed position, position the longitudinal gate in the open position, and position the longitudinal gate to remain an at least partially open position. The longitudinal gate is less than fully open when the longitudinal gate is in the at least partially open position.

In another embodiment, the disclosure includes a gate opening method that includes receiving a signal to transition a longitudinal gate from a closed position to an at least partially open position and actuating a valve to apply a first air pressure level to an inlet port of a pneumatic cylinder in response to receiving the signal to transition the longitudinal gate to the at least partially open position. Applying the first air pressure level to the inlet port of the pneumatic cylinder transitions the longitudinal gate to an at least partially open position, where the longitudinal gate is less than fully open and remains in the at least partially open position. The method further includes receiving a signal to transition the longitudinal gate from the at least partially open position to the closed position and actuating the valve to apply a second air pressure level to the inlet port of the pneumatic cylinder in response to receiving the signal to transition the longitudinal gate to the closed position. Applying the second air pressure level to the inlet port of the pneumatic cylinder transitions the longitudinal gate to the closed position.

Various embodiments present several technical advantages, such as providing a gate system that allows a railcar (e.g. a hopper car) to employ a variable discharge flowrate when unloading a commodity from the railcar. The gate system provides the ability for a railcar to adjust its discharge flowrate between 0-100% of a maximum discharge flow-rate. This provides more flexibility than existing systems that can only be configured to with either a 0% discharge flowrate (i.e. fully closed) or a 100% discharge flowrate (i.e. fully open). In addition, the gate system allows the railcar to partially unload the railcar by temporarily configuring the gate system in a configuration to discharge the commodity from the railcar and then configuring the gate system to another configuration to discontinue discharging the commodity from the railcar.

Certain embodiments of the present disclosure may include some, all, or none of these advantages. These advantages and other features will be more clearly understood from the following detailed description taken in conjunction with the accompanying drawings and claims.

BRIEF DESCRIPTION OF THE DRAWINGS

For a more complete understanding of this disclosure, reference is now made to the following brief description, taken in connection with the accompanying drawings and detailed description, wherein like reference numerals represent like parts.

DETAILED DESCRIPTION

Disclosed herein are various embodiments of a gate system that provides a variable discharge flowrate for a railcar (e.g. a covered or open hopper). The gate system comprises a controller that allows the railcar to adjust the discharge flowrate. The gate system adjusts the position of discharge gates or door on the railcar in order to control the discharge rate of a commodity. For example, the gate system positions the gates in a closed position to prevent a commodity from being discharged from a railcar. The gate system positions the gates such that the gates are at least partially aligned to allow a commodity to be discharged from the railcar. By adjusting the position of the gates, the gate system can adjust the discharge rate of a commodity. Unlike existing systems that have a binary flowrate (i.e. fully open or fully closed), the gate system provides a variable flowrate by allowing partial to full opening of the gates when discharging a commodity.

Figure 1:
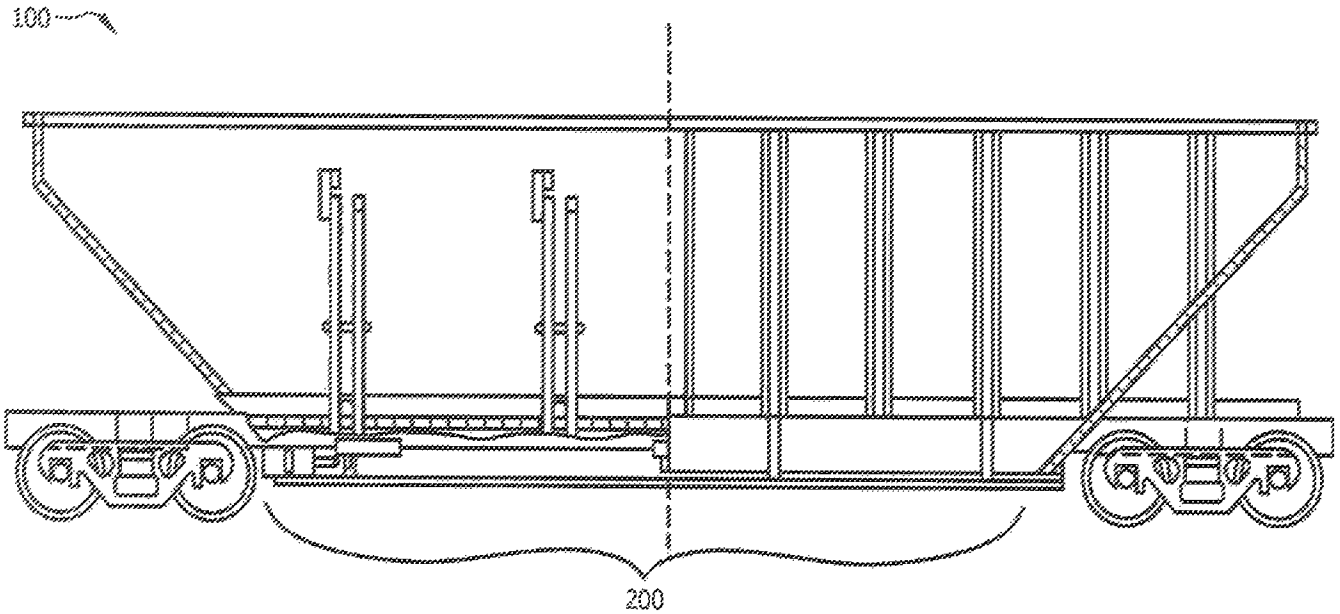
FIG. 1 is a partial cutaway side view of an embodiment of railcar with a gate system.

FIG. 1 is a partial cutaway side view of an embodiment of railcar 100 with a gate system 200. In FIG. 1, the railcar 100 is a hopper car. A hopper car is configured to carry and transport bulk materials such as coal, lading material, sand, grain, metal ores, aggregate, ballast, and/or any other suitable type of material. In other embodiments, the railcar 100 may be a gondola car, a closed hopper car, or another suitable type of railcar.

In one embodiment, the railcar 100 is configured with an open top and bottom discharge openings or outlets. The railcar 100 comprises one or more longitudinal gates (not shown) configured to open and close to control the discharge of materials from the discharge openings of the railcar 100. In other embodiments, the railcar 100 comprises sliding gates, transverse gates, or any other suitable type of door or gate.

In one embodiment, the gate system 200 is disposed at or near a bottom portion of the railcar 100. The gate system 200 is configured to allow commodities to be discharged from the railcar 100 via the one or more longitudinal gates of the railcar 100. For example, the gate system 200 is configured to open longitudinal gates to allow commodities to discharge from the railcar 100. The gate system 200 is configured to allow an operator to adjust the discharge flowrate of railcar 100 while discharging a commodity. The gate system 200 is further configured to allow an operator to pause or interrupt the discharging of a commodity. For example, the gate system 200 may transition the longitudinal gates from a partially open position to closed position and then back to the partially open position after some delay. The delay may be in terms of seconds, minutes, hours, or any other suitable amount of time. Additional information about the gate system 200 is described in FIGS. 2, 3, and 4.

Figure 2:
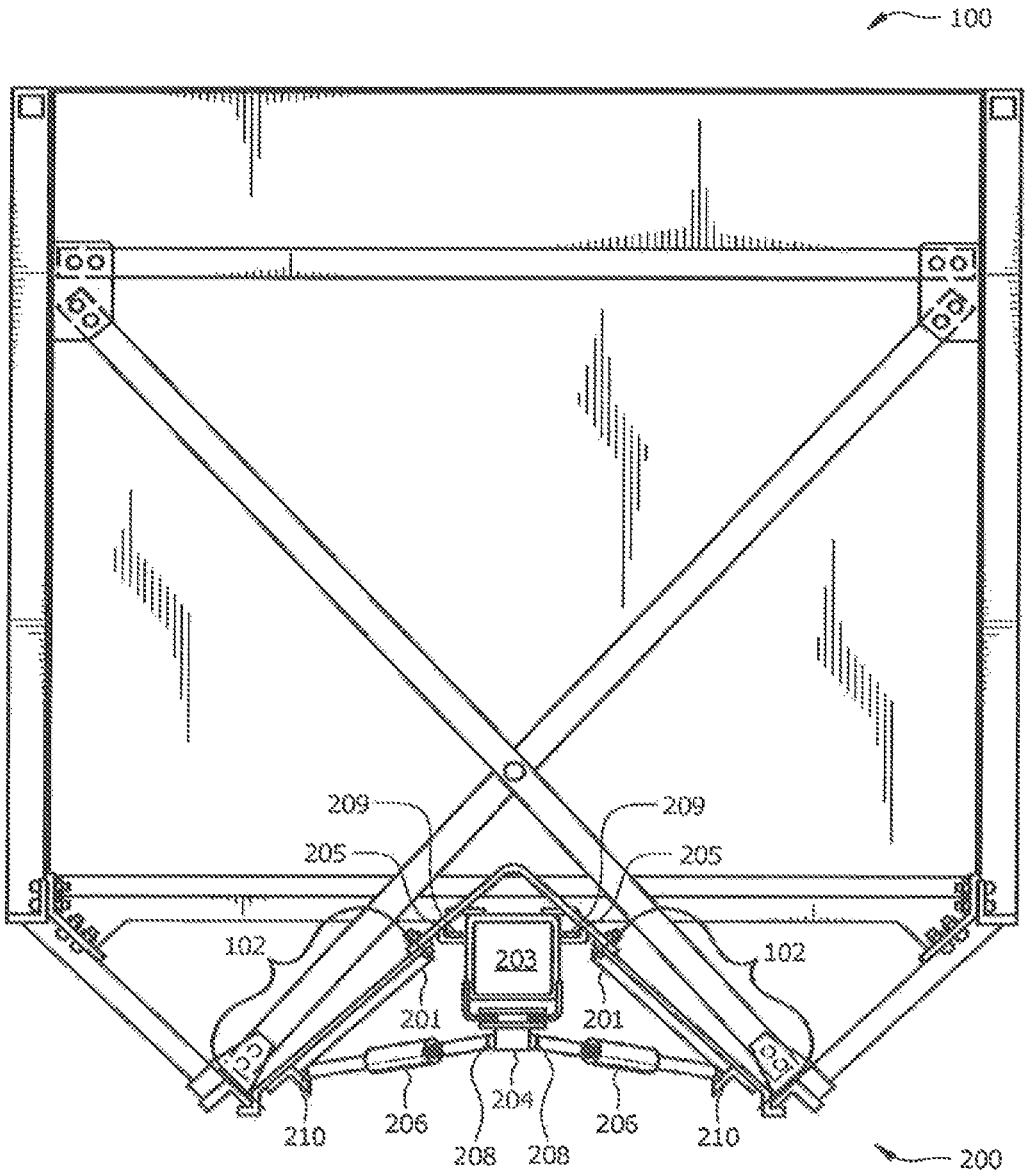
FIG. 2 is an end view of an embodiment of a railcar with longitudinal gates in a closed position.
Figure 3:
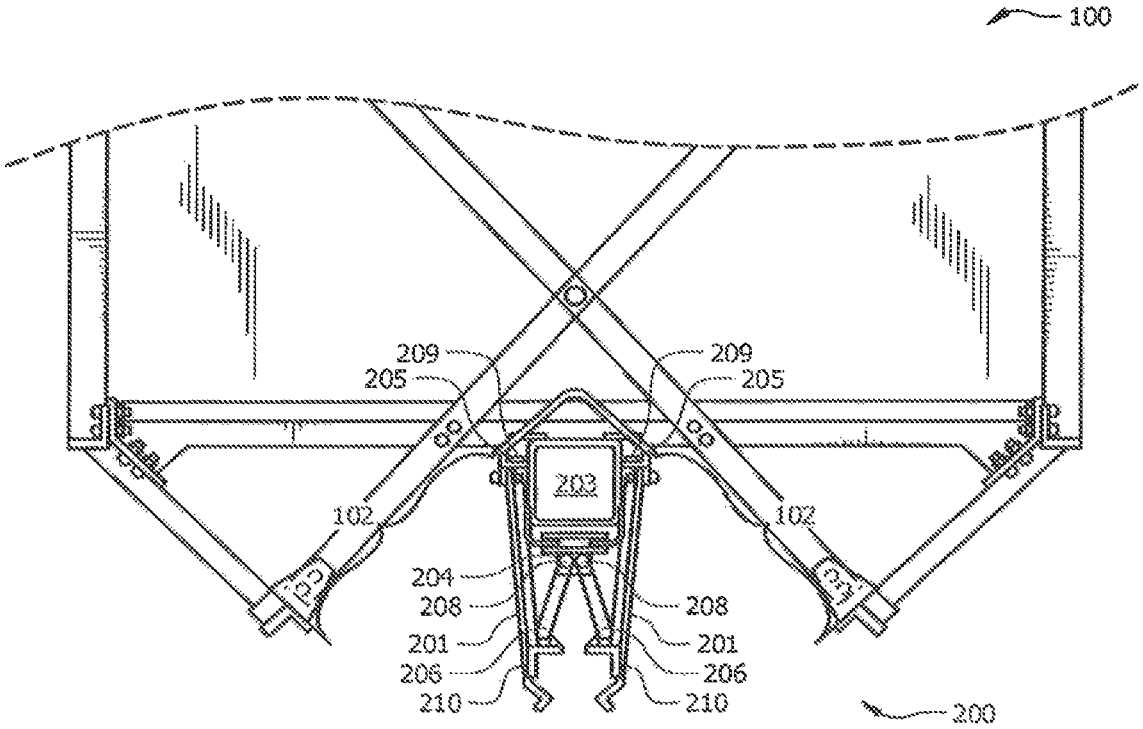
FIG. 3 is an end view of an embodiment of a railcar with longitudinal gates in an open position.

Longitudinal gates are configurable between a closed position (shown in FIG. 2) and an open position (shown in FIG. 3). FIG. 2 is an end view of an embodiment of the railcar 100 with longitudinal gates 201 in a closed position. Longitudinal gates 201 are formed with dimensions suitable for covering discharge openings 102 of a railcar 100. Longitudinal doors 201 may be formed of metals, composites, plastics, or any other suitable material as would be appreciated by one of ordinary skill in the art. When the longitudinal gates 201 are in the closed position, the longitudinal gates 201 substantially prevent material from being discharged from the railcar 100. For example, the longitudinal gates 201 are positioned to cover discharge openings 102 on the bottom of the railcar 100 when the longitudinal gates 201 are in the closed position.

The longitudinal gates 201 are coupled to a center sill 203 at a first end 209 of the longitudinal gate 201 using a hinge assembly 205 and to a strut 206 at a second end 210 of the longitudinal gate 201. The center sill 203 may form a portion of the frame or underframe of the railcar 100. The center sill 203 is oriented longitudinally with respect to the railcar 100. In FIG. 2, the center sill 203 is shown having a generally rectangular cross-section. In other examples, the center sill 203 may have any other shape cross-section. The hinge assembly 205 is configured to pivotally attach the longitudinal gate 201 to the center sill 203. The hinge assembly 205 comprises a mechanical hinge that allows the longitudinal gates 201 to transition between the closed position and the open position. Examples of hinges include, but are not limited to, piano type hinges, spring hinges, continuous hinges, butt hinges, slip apart hinges, and weld-on hinges.

In one embodiment, the struts 206 may have an adjustable length. For example, the struts 206 may comprise a turnbuckle forming part of the strut 206. The turnbuckle is configured such that rotating the turnbuckle extends or contracts the length of a strut 206. The struts 206 further comprise ball joints or links configured to engaged with and connect the strut 206 to other components (e.g. the longitudinal gate 201). In one embodiment, the strut 206 is configured to apply a compressive force to maintain the longitudinal gate 201 in the closed position.

The strut 206 is configured to couple the longitudinal gates 201 with a beam 204. The beam 204 is slidably coupled to the center sill 203 and is configured to move (e.g. slide) longitudinally with respect to the railcar 100 along the center sill 203. The longitudinal gates 201 are configured to transition between the closed position and the open position based on the position of the beam 204.

FIG. 3 is an end view of an embodiment of the railcar 100 with longitudinal gates 201 in an open position. When the longitudinal gates 201 are in the open position, the longitudinal gates 201 allow material to be discharged from the railcar 100. For example, the longitudinal gates 201 are positioned to at least partially uncover the discharge openings 102 which allows material to exit the railcar 100 via the discharge openings 102 on the bottom of the railcar 100.

The gate system 200 is configured to position the longitudinal gates 201 in the closed position (e.g. shown in FIG. 2), the open position (e.g. shown in FIG. 3), or in a partially open position. When the longitudinal gates 201 are in the partially open position, the longitudinal gates 201 obstruct at least a portion of the discharge openings 102 which reduces the discharge flowrate of the railcar 100. The gate system 200 is configured position the longitudinal gates 201 to reduce the discharge flowrate of the railcar by any suitable amount or percentage. For example, the gate system 200 may position the longitudinal gates 201 to be about halfway open to reduce the discharge flowrate by 50%.

Figure 4:
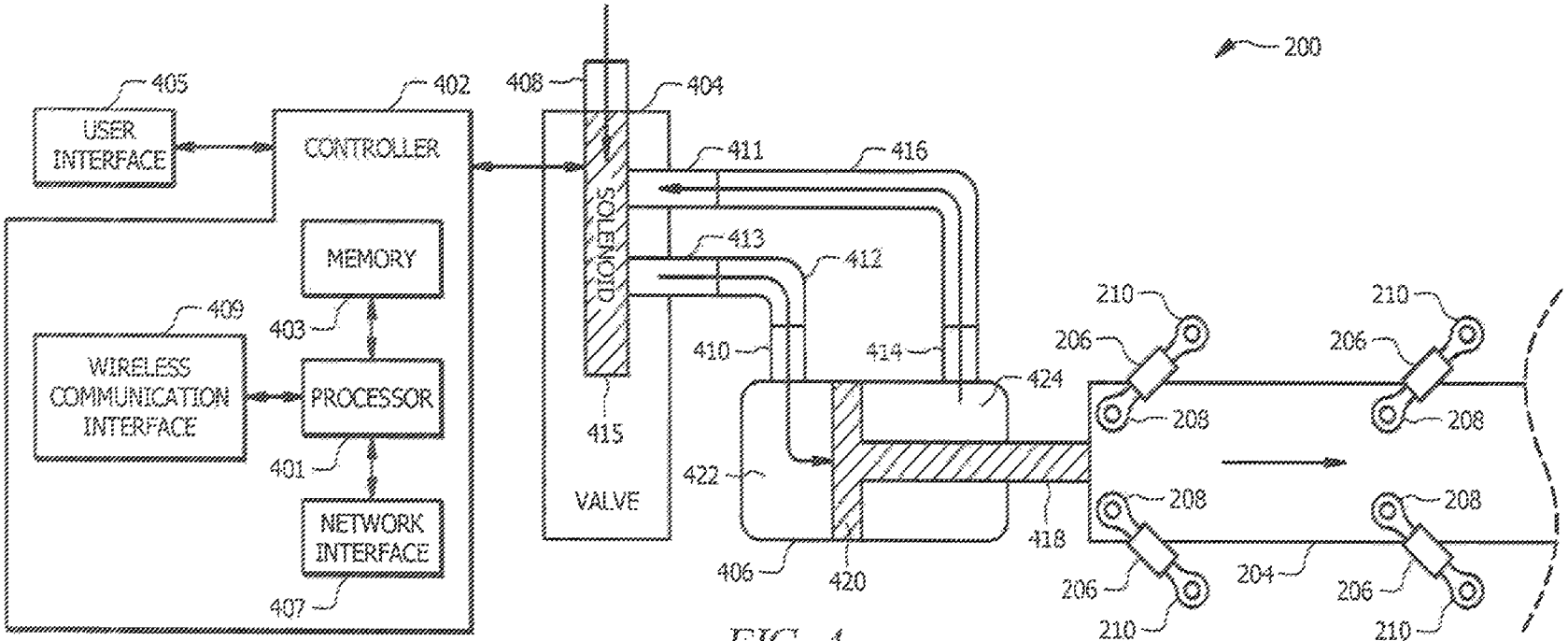
FIG. 4 is a schematic view of an embodiment of a gate system.

FIG. 4 is a schematic view of an embodiment of a gate system 200. The gate system 200 comprises a controller 402, a valve 404, a driving system 406, and a beam 204. The gate system 200 may be configured as shown or in any other suitable configuration. For example, the gate system 200 may comprise additional or alternative components and/or one or more components may be omitted.

The controller 402 is operably coupled to the valve 404 and is configured to operate (e.g. actuate) the valve 404 to open, close, and position longitudinal gates 201. In one embodiment, the controller 402 comprises one or more processors 401 operably coupled to a memory 403. The one or more processors 401 are implemented as one or more central processing unit (CPU) chips, logic units, cores (e.g. a multi-core processor), field-programmable gate array (FPGAs), application specific integrated circuits (ASICs), or digital signal processors (DSPs). The one or more processors 401 are communicatively coupled to and in signal communication with the memory 403. The one or more processors 401 are configured to process data and may be implemented in hardware or software. The one or more processors 401 are configured to implement various instructions. For example, the one or more processors 401 are configured to implement instructions for operating and controlling the gate system 200. The memory 403 comprises one or more disks, tape drives, or solid-state drives, and may be used as an over-flow data storage device, to store programs when such programs are selected for execution, and to store instructions and data that are read during program execution. The memory 403 may be volatile or non-volatile and may comprise read-only memory (ROM), random-access memory (RAM), ternary content-addressable memory (TCAM), dynamic random-access memory (DRAM), and static random-access memory (SRAM). The memory 403 is operable to store an any data or instructions.

In one embodiment, the controller 402 comprises or is in signal communication with a user interface 405. Examples of a user interface 405 include, but are not limited to a graphical user interface, input-output (I/O) interface, a touch screen, a touch pad, a keyboard, and a computer mouse. The user interface 405 is configured to allow an operator control the gate system 200. For example, an operator employs the user interface 405 to operate the gate system 200 and to control the discharge flowrate of the railcar 100 by opening, closing, or positioning the longitudinal gates 201.

In one embodiment, the controller 402 comprises a network interface 407. The network interface 407 is configured to enable wired and/or wireless communications and to communicate data through a network, system, and/or domain. For example, the network interface 407 is configured for communication with a modem, a switch, a router, a bridge, a server, or a client. The controller 402 is configured to receive data using the network interface 407 from a network or a remote source.

In one embodiment, the controller 402 comprises a wireless communication interface 409. Examples of the wireless communication interface 409 include, but are not limited to, a Bluetooth interface, a radio frequency identifier (RFID) interface, a near-field communication (NFC) interface, a local area network (LAN) interface, a personal area network (PAN) interface, a wide area network (WAN) interface, a Wi-Fi interface, a ZigBee interface, or any other suitable wireless communication interface as would be appreciated by one of ordinary skill in the art upon viewing this disclosure. The wireless communication interface 409 is configured to allow the controller 402 to communicate with other devices. For example, the wireless communication interface 409 is configured to allow the controller 402 to send and receive signals from other devices (e.g. a key fob, a mobile phone, or tablet computer). The wireless communication interface 409 is configured to employ any suitable communication protocol.

In other embodiments, the controller 402 may integrated or interchanged with any suitable device that allows an operator to manually operate the gate system 200. For example, a lever, a capstan, or any other suitable device may be used to allow the operator to manually operate the gate system 200. For instance, a lever may be used to manually open, close, or position the longitudinal gates 201.

Examples of the valve 404 include, but are not limited to, a mechanical valve and an electro-mechanical valve. The valve 404 is operably coupled to the controller 402 and the driving system 406. The valve 404 is configured to receive signals from the controller 402 and to control and meter the amount of air or fluid that enters the driving system 406 based on the received signals. In one embodiment, the valve 404 comprises a supply port 408, a output port 413, a return port 411, and a solenoid 415.

The supply port 408 is configured to receive air or fluid for operating the gate system 200. For example, the supply port 408 is configured to receive air, for example, from an air compressor, that is used to generate an air pressure sufficient to move a piston 418 of the driving system 406 and a beam 204.

The output port 413 is configured to provide air or fluid from the supply port 408 to the driving system 406. The output port 413 is coupled to an inlet port 410 of the driving system 406 using a first conduit 412. The first conduit 412 is configured to provide a flow path between the output port 413 of the valve 404 and the inlet port 410 of the driving system 406. Examples of the first conduit 412 include, but are not limited to, tubing, hosing, piping, and any other suitable structure for communicating air or fluid between the valve 404 and the driving system 406.

The return port 411 is configured to receive air or fluid from the driving system 406. The return port 411 is coupled to an outlet port 414 of the driving system 406 using a second conduit 416 The second conduit 416 may be configured similar to the first conduit 412 described above.

The solenoid 415 is configured to control the amount of air or fluid communicated from the supply port 408 to the output port 413. The amount of air or fluid communicated from the supply port 408 to the output port 413 may be proportional to how open the longitudinal gates 201 are. For example, the solenoid 415 may allow 0% of the air received by the supply port 408 to be communicated to the output port 413 to position the longitudinal gates 201 in the closed position. The solenoid 415 may allow 100% of the air received by the supply port 408 to be communicated to the output port 413 to position the longitudinal gates 201 in the open position. The solenoid 415 may allow less than 100% of the air received by the supply port 408 to be communicated to the output port 413 to position the longitudinal gates 201 in at least partially open position. For instance, the solenoid 415 may allow 50% of the air received by the supply port 408 to be communicated to the output port 413 to position the longitudinal gates 201 to be about half way open. As another example, the solenoid 415 may allow 25% of the air received by the supply port 408 to be communicated to the output port 413 to position the longitudinal gates 201 to be about a quarter of the way open.

In one embodiment, the solenoid 415 controls the amount of air or fluid communicated from the supply port 408 to the output port 413 based on electrical signals received from the controller 402. For example, the solenoid 415 may be configured to receive a pulse width modulated electrical signal from the controller 402 indicating a position for the solenoid 415 and/or the amount of air or fluid to communicate from the supply port 408 to the output port 413. In another embodiment, the solenoid 415 controls the amount of air or fluid communicated from the supply port 408 to the output port 413 based on a magnetic field or light. For example, the controller 402 may be configured to adjust the solenoid 415 in response to detecting a magnetic field, magnetic flux, hall effects, or any other suitable type of electromagnetic energy.

In another embodiment, the solenoid 415 controls the amount of air or fluid communicated from the supply port 408 to the output port 413 based on mechanical or physical adjustment by the controller 402 or an operator. For example, an operator may use a lever to adjust the solenoid 415 to a position and to communicate air or fluid from the supply port 408 to the output port 413. In other embodiments, the solenoid 415 receives a command to control the amount of air or fluid communicated from the supply port 408 to the output port 413 using any other type of signal or interaction by the controller 402 and/or an operator.

In one embodiment, the valve 404 (e.g. the solenoid 415) may be actuated and controlled based on global positioning data or proximity signals. For example, a geo fence may be used to arm or disarm the gate system 200. When the gate system 200 is armed, the gate system 200 may close and/or lock the longitudinal gates 201. When the gate system 200 is disarmed, the gate system 200 may open and/or unlock the longitudinal gates 201. As another example, a proximity switch may be used to actuate and control the valve 404.

The driving system 406 is operably coupled to the beam 204 and is configured to move the beam 204 longitudinally with respect to the railcar 100. For example, the driving system 406 is configured to slide the beam 204 along the center sill 203. In FIG. 4, the driving system 406 is a pneumatic cylinder. In this example, the driving system 406 comprises an inlet port 410, an outlet port 414, and a piston 418. The inlet port 410 is configured to allow an air pressure to be applied to a first interior chamber 422 of the driving system 406. The outlet port 414 is configured to allow air to exit a second interior chamber 424 of the driving system 406. For example, an air pressure may be applied to the first interior chamber 422 to move the piston 418 within the driving system 406. Air within the second interior chamber 424 of the driving system 406 may exit the driving system 406 as the piston 418 moves.

The piston 418 is configured with a head portion 420 of the piston 418 disposed within the driving system 406 and a portion of the piston 418 protruding out of the driving system 406. The piston 418 is configured to move (e.g. slide) in response to an air pressure being applied to the first interior chamber 422 of the driving system 406. The piston 418 is configured to protrude further out of the driving system 406 as the level of air pressure being applied to the first interior chamber 422 increases. The piston 418 is coupled to the beam 204 and is configured to move the beam 204 as the piston 418 moves.

In other embodiment, the driving system 406 comprises a hydraulic cylinder, a motor, levers, gears, capstans, cables, ropes, or any other suitable devices configured to move the beam 204 longitudinally with respect to the railcar 100. For example, the driving system 406 may be a hydraulic cylinder configured to operate similar to the previously described pneumatic cylinder. In this example, the driving unit 406 is configured to move the beam 204 in response to an application of a hydraulic fluid pressure being applied to the first interior chamber 422 of the hydraulic cylinder.

As another example, the driving system 406 may be a motor comprising a rotating shaft. In this example, the driving system 406 is configured to receive a signal from the controller 402 and to move the beam 204 by rotating the shaft based on the received signal. For instance, the rotating shaft may be coupled to a gear assembly that is configured to move the beam 204 as the shaft rotates.

The beam 204 comprises struts 206 that are coupled to the beam 204 at a first end 208 of the struts 206 and coupled to a longitudinal gate 201 (not shown) at a second end 210 of the shuts 206. The struts 206 are configured to move the longitudinal gates 201 between the closed position and the open position as the beam 204 moves longitudinally with respect to the railcar 100.

Figure 5:
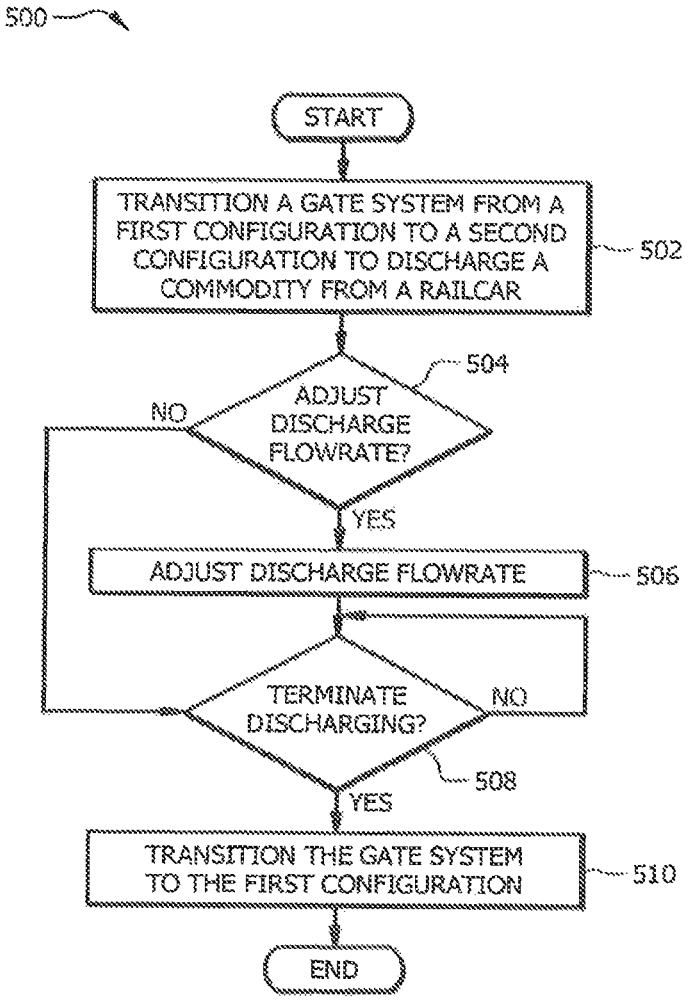
FIG. 5 is a flowchart of an embodiment of a gate opening method.

FIG. 5 is a flowchart of an embodiment of a gate opening method 500. In an embodiment, an operator or controller 402 may employ method 500 to control the discharge flowrate of a commodity from a railcar 100. For example, the controller 402 may adjust the discharge flowrate of the railcar 100 while unloading the railcar 100. The railcar 100 may be positioned at or proximate to a site where the commodity the railcar 100 is carrying can be unloaded.

At step 502, the controller 402 transitions the gate system 200 from a first configuration to a second configuration to discharge a commodity from the railcar 100. When the gate system 200 is in the first configuration, the gate system 200 is configured to substantially disallow the commodity from being discharged from the railcar 100. The longitudinal gates 201 are in the closed position when the gate system 200 is configured in the first configuration.

The controller 402 may transition the gate system 200 in response to receiving a user command, a user performing an action (e.g. moving a lever), receiving a wireless signal, or receiving any other suitable type of command or trigger. In one embodiment, the driving system 406 is a pneumatic cylinder. The controller 402 actuates the valve 404 (e.g. the solenoid 415) to allow air to be communicated to the inlet port 410 of the driving system 406. The air communicated to the inlet port 410 of the driving system 406 generates an air pressure force that moves piston 418 of the pneumatic cylinder and the beam 204 coupled to the piston 418. As the piston 418 moves in a direction toward the beam 204, the beam 204 transitions longitudinal gates 201 from the closed position to an at least partially open position.

At step 504, the controller 402 determines whether to adjust the discharge flowrate. In one embodiment, the controller 402 may receive input from an operator indicating to either increase or decrease the discharge flowrate. In another embodiment, the controller 402 may comprise instructions to progressively adjust the discharge flowrate over time, for example, at predetermined intervals of time. When the controller 402 determines that the discharge flowrate should be adjusted, the controller proceeds to step 506. Otherwise, the controller 402 proceeds to step 508.

At step 506, the controller 402 adjusts the discharge flowrate. For example, the controller 402 actuates the valve 404 to increase the amount of air communicated to the inlet port 410 of the driving system 406. The air communicated to the inlet port 410 of the driving system 406 generates an air pressure force greater than the previous air pressure force which is sufficient to further move the piston 418 in the direction of the beam 204. As the piston 418 moves in the direction toward the beam 204, the beam 204 moves to a position that further opens the longitudinal gates 201 and increases the discharge flow rate.

As another example, the controller 402 actuates the valve 404 to reduce the amount of air communicated to the inlet port 410 of the driving system 406. For instance, the controller 402 may actuate the valve 404 to create a vacuum or pressure differential that reduces the amount of air communicated to the inlet port 410 of the driving system 406. The reduction of air communicated to the inlet port 410 of the driving system 406 causes the piston 418 to move in a direction away from the beam 204. As the piston 418 moves in the direction away from the beam 204, the beam 204 moves the longitudinal gates 201 to a position that reduces the discharge flowrate.

At step 508, the controller 402 determines whether to terminate discharging the commodity. The controller 402 may determine to terminate discharging the commodity in response to a user input or command, in response to a timer expiring, in response to sensing the commodity has been unloaded, or based on any other suitable type of command or criteria. For example, the controller 402 may use motion sensors, pressure sensors, light sensors, and/or any other suitable type of sensors for determining whether a commodity has been unloaded from the railcar 100. When the controller 402 determines that discharging the commodity should be terminated, the controller proceeds to step 510. Otherwise, the controller 402 remains at step 508 and continues to monitor for when to terminate discharging the commodity.

At step 510, the controller 402 transitions the gate system 200 to the first configuration. In one embodiment, the controller 402 actuates the valve 404 to reduce the amount of air communicated to the inlet port 410 of the driving system 406. The reduction of air communicated to the inlet port 410 of the driving system 406 causes the piston 418 to move in a direction away from the beam 204. As the piston 418 moves in the direction away from the beam 204, the beam 204 moves the longitudinal gates 201 to the closed position.

In other embodiments, steps 502, 506, and 510 may be performed manually by an operator. For example, an operator may use a level or capstan to manually open, adjust, and close the longitudinal gates 201.

While several embodiments have been provided in the present disclosure, it should be understood that the disclosed systems and methods might be embodied in many other specific forms without departing from the spirit or scope of the present disclosure. The present examples are to be considered as illustrative and not restrictive, and the intention is not to be limited to the details given herein. For example, the various elements or components may be combined or integrated in another system or certain features may be omitted, or not implemented.

In addition, techniques, systems, subsystems, and methods described and illustrated in the various embodiments as discrete or separate may be combined or integrated with other systems, modules, techniques, or methods without departing from the scope of the present disclosure. Other items shown or discussed as coupled or directly coupled or communicating with each other may be indirectly coupled or communicating through some interface, device, or intermediate component whether electrically, mechanically, or otherwise. Other examples of changes, substitutions, and alterations are ascertainable by one skilled in the art and could be made without departing from the spirit and scope disclosed herein.

To aid the Patent Office, and any readers of any patent issued on this application in interpreting the claims appended hereto, applicants note that they do not intend any of the appended claims to invoke 35 U.S.C. § 112(f) as it exists on the date of filing hereof unless the words "means for" or "step for" are explicitly used in the particular claim.

The invention claimed is:

1. A gate opening method comprising:

receiving, at a controller, a signal to transition a longitudinal gate from a closed position to an at least partially open position, wherein:

the longitudinal gate disallows a flow path via a discharge opening when the longitudinal gate is in the closed position, and the longitudinal gate allows a flow path via the discharge opening when the longitudinal gate is in the at least partially open position;

actuating, by the controller, a valve to apply a first pressure level to an inlet port of a pneumatic cylinder in response to receiving the signal to transition the longitudinal gate to the at least partially open position, wherein:

actuating the valve to apply the first pressure level comprises sending a pulse width modulated signal to a solenoid of the valve, wherein:

the pulse width modulated signal indicates an amount of fluid to communicate from a supply port of the valve to an output port of the valve;

the amount of fluid to communicate from the supply port of the valve to the output port of the valve is proportional to a percentage that the longitudinal gates are open; and the solenoid is configured to communicate the amount of fluid from the supply port of the valve to the output port of the valve to apply the first pressure level in response to receiving the pulse width modulated signal;

applying the first pressure level transitions the longitudinal gate to an at least partially open position;

the longitudinal gate is less than fully open, and the longitudinal gate remains in the at least partially open position;

receiving, at the controller, a signal to transition the longitudinal gate from the at least partially open position to the closed position; and actuating, by the controller, the valve to apply a second pressure level to the inlet port of the pneumatic cylinder in response to receiving the signal to transition the longitudinal gate to the closed position, wherein applying the second pressure level transitions the longitudinal gate to the closed position.

2. The method of claim 1, further comprising:

receiving, at the controller, a signal to transition the longitudinal gate to another position where the longitudinal gate is less than fully open when the longitudinal gate is in the at least partially open position; and actuating, by the controller, the valve to apply a third pressure level to the inlet port of the pneumatic cylinder in response to receiving the signal to transition the longitudinal gate to another position.

3. The method of claim 2, wherein actuating the valve to apply the third pressure level to the inlet port of the pneumatic cylinder comprises reducing the amount of air pressure applied to the inlet port of the pneumatic cylinder.

4. The method of claim 2, wherein actuating the valve to apply the third pressure level to the inlet port of the pneumatic cylinder comprises increasing the amount of pressure applied to the inlet port of the pneumatic cylinder.

5. The method of claim 1, wherein receiving the signal to transition the longitudinal gate to the at least partially open position is an input from an operator using a user interface.

6. The method of claim 1, wherein receiving the signal to transition the longitudinal gate to the at least partially open position is an input from an operator using a mechanical lever.

7. The method of claim 1, wherein receiving the signal to transition the longitudinal gate to the at least partially open position is from a wireless device.

8. The method of claim 1, wherein receiving the signal to transition the longitudinal gate to the closed position is in response to a timer expiring.

9. The method of claim 1, wherein receiving the signal to transition the longitudinal gate to the closed position is in response to sensing a commodity has been unloaded.

10. The method of claim 1, wherein receiving the signal to transition the longitudinal gate to the closed position is in response to receiving a signal from a proximity switch.

11. The method of claim 1, wherein receiving the signal to transition the longitudinal gate to the closed position is in response to receiving a signal from a geo fence.

* * * * *